US005433976A

United States Patent [19]

van Ooij et al.

[11] Patent Number: 5,433,976

[45] Date of Patent: * Jul. 18, 1995

[54] METAL PRETREATED WITH AN AQUEOUS SOLUTION CONTAINING A DISSOLVED INORGANIC SILICATE OR ALUMINATE, AN ORGANOFUCTIONAL SILANE AND A NON-FUNCTIONAL SILANE FOR ENHANCED CORROSION RESISTANCE

[75] Inventors: Wim J. van Ooij, Fairfield; Ashok Sabata, Middletown, both of Ohio

[73] Assignee: Armco, Inc., Middletown, Ohio

[ * ] Notice: The portion of the term of this patent subsequent to Jun. 21, 2011 has been disclaimed.

[21] Appl. No.: 207,565

[22] Filed: Mar. 7, 1994

[51] Int. Cl.[6] ..... B05D 3/12

[52] U.S. Cl. ..... 427/327; 427/337; 427/388.4; 427/387

[58] Field of Search ..... 427/327, 337, 388.4, 427/387

[56] References Cited

U.S. PATENT DOCUMENTS

| | | | |
|---|---|---|---|
| 4,407,899 | 10/1983 | Hara et al. | 428/626 |
| 4,411,964 | 10/1983 | Hara et al. | 428/626 |
| 4,889,775 | 12/1989 | Adaniya et al. | 428/62 B |
| 5,108,793 | 4/1992 | van Ooij et al. | 427/327 |
| 5,292,549 | 3/1994 | Ooij | 427/387 |
| 5,322,713 | 6/1994 | Sabata et al. | 427/327 |
| 5,326,594 | 7/1994 | Sabata | 427/327 |

FOREIGN PATENT DOCUMENTS

| | | |
|---|---|---|
| 141436 | 11/1977 | Japan . |
| 50179 | 8/1983 | Japan . |
| 162560 | 1/1985 | Japan . |
| 7877 | 6/1986 | Japan . |
| 56878 | 8/1987 | Japan . |
| 130796 | 2/1988 | Japan . |

*Primary Examiner*—Sam Silverberg

*Attorney, Agent, or Firm*—R. J. Bunyard; L. A. Fillnow; R. H. Johnson

[57] ABSTRACT

Painted metal sheet pretreated with an insoluble, composite layer containing siloxane. The composite layer is formed by rinsing the sheet with an alkaline solution containing at least 0.005M of a dissolved silicate or a dissolved aluminate, at least 0.1 vol.-% of an organofunctional silane and at least 0.02 vol.-% of a cross-linking-agent having two or more trialkoxysilyl groups. After the sheet is dried, the composite layer has a thickness of at least 10 Å. After being painted, the siloxane forms a tenacious covalent bond between the paint and the metal substrate.

13 Claims, No Drawings

METAL PRETREATED WITH AN AQUEOUS SOLUTION CONTAINING A DISSOLVED INORGANIC SILICATE OR ALUMINATE, AN ORGANOFUCTIONAL SILANE AND A NON-FUNCTIONAL SILANE FOR ENHANCED CORROSION RESISTANCE

BACKGROUND OF THE INVENTION

This invention relates to pretreating a metal with a composite layer containing siloxane for forming an adherent covalent bond between an outer paint layer and the metal substrate. More particularly, the invention relates to a one-step process for pretreating metal with an alkaline solution containing at least one of a dissolved inorganic silicate and a dissolved inorganic aluminate, an organofunctional silane and a non-functional silane crosslinking agent.

It is known to improve corrosion resistance of cold rolled and metallic coated steels by passivating the surface with a chromate coating. Because of the toxic nature of hexavalent chromium, rinses containing chromate ions are undesirable for industrial usage.

It also is known to treat cold rolled and metallic coated steels with a phosphate conversion coating to improve paint adherence. To improve the corrosion performance, however, these phosphated steels generally require chromate final rinse.

It has been proposed to improve corrosion resistance and paint adhesion on cold rolled and galvanized steel by coating with an inorganic silicate and then treating the silica coating with an organofunctional silane. U.S. Pat. No. 5,108,793 discloses forming the silica coating by rinsing the steel with an alkaline solution containing dissolved silicate and metal salt. The steel is dried to form a silica coating having a thickness of at least 20 Å. Thereafter, the silica coated steel is rinsed with an aqueous solution containing 0.5–5 vol. % organofunctional silane. The silane forms a relatively adherent covalent bond between the silicate coating and an outer paint layer.

There have been numerous other proposals to improve corrosion resistance and paint adhesion on cold rolled and galvanized steels. Some artisans have proposed pretreating the steel with a chromate solution containing colloidal silicate and/or aluminate and silane. Others have proposed rinsing the steel with a chromate solution and then rinsing the chromated steel with a solution containing colloidal silicate or aluminate and silane. Still others have proposed rinsing the steel with a solution containing polymeric resin, colloidal silicate and silane.

As evidenced by the effort of previous workers, there has been a long felt need to develop a process for improving corrosion resistance of and paint adherence to a metal using environmentally safe coating solutions that can be disposed of inexpensively. The process should be low cost, use nontoxic materials that can be safely disposed of, provide long term resistance in a humid environment and not require complex multiple step processing or chromating.

BRIEF SUMMARY OF THE INVENTION

This invention relates to a metal pretreated in a one-step process with a composite layer containing siloxane for forming an adherent covalent bond between paint and the metal substrate. The invention includes rinsing the metal with an alkaline solution containing at least one of a dissolved inorganic silicate and a dissolved inorganic aluminate, an organofunctional silane and a crosslinking agent containing two or more trialkoxysilyl groups. The metal is then dried to completely cure the functional silane to form an insoluble composite layer tightly bonded to the metal substrate.

Another feature of the invention includes the aforesaid alkaline solution containing 0.005M of the silicate, aluminate or mixtures thereof.

Another feature of the invention includes the aforesaid alkaline solution containing at least 0.1 vol.-% each of the organofunctional silane and the crosslinking agent.

Another feature of the invention includes the ratio of the aforesaid organofunctional silane to the crosslinker being in the range of 2:1 to 10:1.

Another feature of the invention includes the additional step of coating the metal with a phosphate layer prior to rinsing with the alkaline solution.

A principal object of the invention is to improve corrosion resistance and paint adhesion of a metal.

Additional objects include improving corrosion resistance and paint adhesion to metal without using toxic materials such as chromates that produce toxic wastes and being able to produce a painted metal having high durability in a humid environment.

Advantages of the invention include forming a composite layer that is insoluble, has excellent affinity for paint on cold rolled and metallic coated steel, including phosphated cold rolled and metallic steel, and has good corrosion resistance. The process of the invention does not use or create environmentally hazardous substances, is low cost and has applicability to a variety of paints.

DETAILED DESCRIPTION OF THE PREFERRED EMBODIMENTS

An important aspect of the invention is to pretreat a metal sheet to be painted with a composite layer containing at least one of an inorganic silicate or an inorganic aluminate and siloxane. Siloxane stabilizes the composite layer thereby increasing corrosion resistance and forms a tenacious covalent bond between an outer layer of paint or other polymers and the metal substrate. Unlike an uncured silane, siloxane has a hydrolytically stable —Si—O—Si— structure impervious to water and is believed to form better adhesion because the siloxane is interdiffused throughout the inner composite layer and the outer paint layer. That is, the siloxane and paint become an interpenetrating network. Siloxane also enhances wettability of paint to the composite layer insuring a continuous film of paint impervious to moisture.

To form a continuous adherent composite layer containing siloxane, an alkaline solution is prepared containing at least one of a dissolved inorganic silicate, a dissolved inorganic aluminate, or a mixture thereof, an organofunctional silane and a silane crosslinking agent having no organic functionality other than two or more trialkoxysilyl groups. The organofunctional silane has the general formula $R_1$—$R_2$—$Si(OX_3)_3$ where $R_1$ is an organofunctional group, $R_2$ is an aliphatic or aromatic hydrocarbon group and X is an alkyl group. For example, $R_1$ can be an —$NH_2$ group, $R_2$ can be a propyl group and X preferably is $CH_3$ or $C_2H_5$. Alternative groups for $R_2$ include any $(CH_2)_x$ chain with x preferably being the integer 3. A preferred organofunctional silane found to perform very well in the invention was γ-aminopropyltriethoxy silane (APS). Examples of other silanes that can be used include γ-glycidoxypropyltrimethoxy (GPS), γ-methacryloxypropyltrimethoxy (MPS), N-[2-(vinylbenzylamino)ethyl]-3-aminopropyltrimethoxy (SAAPS), mercaptopropyltriacetoxy, diaminosilanes such as $NH_2—CH_2—NH—CH_2—CH_2—CH_2—Si(OX)_3$ and vinylpropyltrimethoxy silane.

By an alkaline solution is meant an aqueous solution having a pH greater than 7 and preferably at least 12. It is important that the rinsing solution be alkaline because the organofunctional silanes perform much better. It also is important .that the solution not contain an organic solvent because of environmental concern since the pretreating solution generally is contained in a tank open to the atmosphere.

The non-functional silane or crosslinking agent includes two or more trialkoxysilyl groups having the general structure $R_3$-$(SiOY_3)_n$ where $R_3$ is an aliphatic or aromatic hydrocarbon, Y can be a methyl, ethyl or acetoxy group and n is an integer equal or greater than 2. A preferred silane crosslinking agent is 1,2 bis trimethoxysilyl ethane (TMSE), e.g., $(C_2H_5O)_3Si—CH_2CH_2—(Si(C_2H_5O)_3$. Other possible crosslinking agents include $(CH_3O)_3SiCH_2CH_2CH_2Si(OCH_3)_3$,
$(CH_3O)_3Si(CH_2)_6Si(OCH_3)_3$, $Si(OC_2H_5)_4$,
$(CH_3O)_3SiCH_2CH_2Si(CH_3)_2—O—Si(CH_3)_2CH_2CH_2Si(OCH_3)_3$,
or

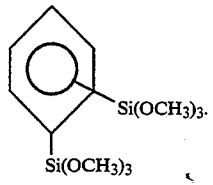

The concentration of the non-functional silane crosslinking agent in the alkaline rinsing solution should be at least 0.02 vol. % with at least 0.2 vol. % being preferred. The concentration should be at least 0.02 vol.-% because the reactivity of the alkaline solution would be too slow at lower concentrations. The concentration of the organofunctional silane in the alkaline rinsing solution should be at least 0.1 vol.-% with at least 0.8 vol. % being preferred to insure that a continuous film is formed. The ratio of the concentration of the organofunctional silane to the concentration of the silane crosslinker preferably should be at least 2:1 but not exceed about 10:1. If the organofunctional silane concentration is less than twice that of the crosslinker, the amount of crosslinker present is excessive and becomes wasted and the number of functional groups is too low to ensure good adhesion of the paint to the composite layer. On the other hand, if the organofunctional silane concentration is more than about ten times that of the crosslinker, the amount of crosslinker present may be insufficient to completely react all of the organofunctional silane and convert to siloxane. A preferred ratio of functional silane to crosslinker is 4:1.

The concentration of neither the crosslinking agent nor the organofunctional silane should exceed about 5.0 vol.-% in the alkaline solution because of excess cost and the thickness of the composite layer may be excessive causing the composite layer to be brittle.

The alkaline solution also contains at least one of a dissolved inorganic silicate, a dissolved inorganic aluminate or a mixture of the silicate and the aluminate. It is important that the composite layer formed from the alkaline solution contain silicate and/or aluminate to provide excellent corrosion protection for a painted metal sheet. The composite silicate and/or aluminate layer preferably has a thickness of at least 10 Å, more preferably at least 20 Å and most preferably a thickness of 50 Å. The composite layer should have a thickness of at least 10 Å to insure a continuous layer tightly bonded to the metal substrate and impervious to moisture. It was determined a minimum concentration of the silicate and/or aluminate in the solution of about 0.005M insures that such a continuous composite layer is formed. At concentrations greater than about 0.05M, corrosion resistance is not improved, costs become excessive and the thickness of the composite layer may become excessive. The composite layer should not have a thickness exceeding about 100 Å because a thick coating is brittle and tends to craze and flake-off when the coated metal is fabricated. Examples of silicates that can be used include $Na(SiO_3)_x$, e.g., waterglass, sodium metasilicate or sodium polysilicate. Examples of aluminates that can be used include $Al(OH)_3$ dissolved in NaOH or $Al_2O_3$ dissolved in NaOH. When inorganic silicate is used, the alkaline solution preferably includes a metal salt such as an alkaline earth metal salt. Any of the alkaline earth salts of $Ba(NO_3)_2$, $Ca(NO_3)_2$ or $Sr(NO_3)_2$ are acceptable for this purpose. After being formed on a steel sheet, the siloxane containing silicate and/or aluminate layer must not be dissolved during subsequently processing or must not be dissolved by the corrosive environment within which the painted sheet is placed. The function of the metal salt is for making the composite silicate layer insoluble. Since the metal salt in the alkaline solution reacts in direct proportion with the dissolved silicate, the concentration of the salt should at least equal the concentration of the dissolved silicate. Accordingly, an acceptable minimum concentration of the metal salt is about 0.005M as well.

The composite layer of the invention can be applied to metal sheets such as hot rolled and pickled steel, cold rolled steel, hot dipped or electroplated metallic coated steel, chromium alloyed steel and stainless steel. An aluminate composite layer of the invention has particular use for pretreating non-ferrous metals such as aluminum or aluminum alloy or steel coated with aluminum or aluminum alloy. Metallic coatings may include aluminum, aluminum alloy, zinc, zinc alloy, lead, lead alloy and the like. By sheet is meant to include continuous strip or foil and cut lengths. The present invention has particular utility for providing good paint adhesion for phosphated steels to be painted. Steel sheets to be painted, particularly cold rolled steel, may first be coated with a phosphate conversion layer prior to applying the siloxane containing composite layer of the invention. The composite layer improves corrosion protection and strengthens the bond between the paint and the phosphated substrate.

An advantage of the invention is being able to quickly pretreat a metal sheet in a short period of time. Coating times in excess of 30 seconds generally do not lend themselves to industrial applicability. It was determined a phosphated steel pretreated with the composite layer of the invention can be formed in short rinse times of less than 30 seconds, preferably less than 10 seconds. Another advantage is that an elevated rinsing temperature is not required for the alkaline solution when forming the composite layer. Ambient temperature, e.g., 25°

C., and rinsing times of as quick as 2–5 seconds can be used with the invention.

Example 1

By way of an example, hot dip galvanized steel test panels were pretreated with an alkaline solution of the invention. After these test panels were painted, their corrosion resistance was compared to conventionally pretreated hot dip galvanized steel test panels. Conventional pretreatment coatings formed on various comparison panels were formed by rinsing with standard solutions including a phosphate conversion solution, a chromate solution and an alkaline solution containing dissolved silicate. These standard pretreatment coatings also may have been rinsed with another solution containing a silane. A silicate solution was prepared by dissolving 0.015M waterglass and 0.015M $Ca(NO_3)_2$ in water. An organofunctional silane solution was prepared by dissolving 2.4 vol. % of APS silane in water. A non-functional silane solution was prepared by dissolving 0.6 vol. % of TMSE crosslinking agent in water. To form one embodiment of an alkaline solution of the invention, equal volumes of the three solutions were mixed together immediately after being hydrolyzed in the ratio of 1:1:1 with the pH adjusted to 12 using NaOH. The alkaline solution of the invention contained 0.005M silicate, 0.005M salt, 0.8 vol. % APS and 0.2 vol. % TMSE. After being solvent cleaned, the test panels were given various pretreatments. The phosphate conversion process including phosphate sold under the trade name of Chemfil 952. Test panels of the invention were rinsed with the alkaline solution for 10 seconds to form composite layer containing silicate and organofunctional silane. The organofunctional silane was cured in air by the crosslinker into siloxane which became interspersed throughout the composite layer. The composite layer had an average thickness of about 15 Å on each side of the test panels. All the test panels then were coated with an inner standard automotive E-coat plus an outer standard automotive acrylic-melamine topcoat. The thickness of the E-coat and acrylic topcoat was about 100 μm. After painting, the test panels were scribed through the paint and composite layer and into the steel base metal. The scribed panels then were exposed for eight weeks to the standard cyclic General Motors scab corrosion test. After completion of the test, the panels were washed in water, dried and loose paint was removed by brushing. The test panels were visually observed for scribe creepback, i.e., propagation of corrosion under the paint from the scribe mark. Results are summarized in Table 1.

TABLE 1

| Pretreatment | Creepback (mm) |
|---|---|
| Phos only | 1.40 |
| Phos + Chromate | 1.13 |
| Phos + Silicate | 0.93 |
| Phos + APS silane | 1.26 |
| Phos + Silicate + APS silane | 0.90 |
| Invention (Phos + Silicate + APS silane + TMSE xlinker) | 0.75 |

The results demonstrate that a conventional pretreatment of phosphate followed by a chromate rinse (the generally accepted industrial standard) would be better than conventional phosphate pretreatment alone. Further improvement can be obtained using a conventional silicate pretreatment. Adding a final silane rinse to panels pretreated with conventional phosphate or chromate treatments, however, adds little additional corrosion resistance, e.g., creepback reduced from 0.93 mm to 0.90 mm. A significant improvement in the corrosion resistance, e.g., creepback reduced to 0.75 mm, was obtained when the phosphated test panels were pretreated with an alkaline solution of the invention containing a non-functional silane crosslinker.

Example 2

In another example, hot dip galvanized steel test panels were evaluated for corrosion as well as paint adherence similar to that described in Example 1 except none of the comparison test panels were pretreated with a phosphate conversion coating after cleaning. In addition to being evaluated using the GM scab test, the test panels were given an NMPRT* paint adherence test as well. Results are summarized in Table 2.

TABLE 2

| Pretreatment | Creepback (mm) | NMPRT (min.)* |
|---|---|---|
| None | 2.2 | 1.5 |
| APS silane only | 1.8 | 2.0 |
| Silicate only | 1.7 | 2.3 |
| Silicate + APS silane | 1.4 | 9.5 |
| Invention (Silicate + APS + TMSE xlinker) | 1.1 | 30 |

*NMPRT is a measure of paint adherence to the substrate using N-methyl pyrrolidone as a swelling solvent to remove the paint as measured in minutes. This test is described in a paper co-authored by the applicant and published in Journal of Adhesion Science and Technology, 7, 897 (1993), incorporated herein by reference.

The results again clearly demonstrate that using the one-step alkaline solution of the invention containing a non-functional silane crosslinking agent can be expected to provide the best corrosion performance, and especially paint adherence. The NMPRT results suggest paint adherence for the test panels of the invention were about three times better than comparison test panels rinsed with a conventional alkaline solution containing silicate and organofunctional silane but not containing a crosslinking agent. These results illustrate that the composite coating of the invention provided improved corrosion resistance and improved paint adhesion for bare metals, i.e., non-phosphated.

Example 3

In another example, hot dip galvanized steel test panels again were evaluated for corrosion and paint adherence similar to that described in Examples 1 and 2. That is, some of the test panels were pretreated with a zinc phosphate conversion coating after cleaning similar to that in Example 1 and others were not pretreated with the phosphate as in Example 2. After the pretreatments, the test panels were coated with a standard polyester powder paint. The powder paint were cured at 170° C. for 30 minutes. The paint had a thickness of about 25 μm. Corrosion and paint adherence results are summarized in Table 3.

TABLE 3

| Pretreatment** | Phosphated Creepback (mm) |
|---|---|
| None | 1.2 |
| Chromate | 0.8 |
| Silicate | 1.0 |
| Silicate + APS silane | 0.6 |
| Invention (Silicate + APS + TMSE crosslinker) | 0.4 |

** All the test panels were phosphated prior to receiving the indicated Pretreatment. For example, the panel indicated by "None" was phosphated only and the panel indicated by "Chromate" was phosphated and then rinsed with chromate, etc.

TABLE 3-continued

| Pretreatment | Non-Phosphated Creepback (mm) | NMPRT(min.) |
|---|---|---|
| None | 1.6 | 3.0 |
| APS silane only | 1.3 | >45 |
| Silicate only | *** 0 | |
| Silicate + APS silane | 0.8 | >45 |
| Invention (Silicate + APS silane + TMSE xlinker) | 0.6 | >45 |

*** Total delamination

The results again demonstrate that using the one-step alkaline solution of the invention containing a non-functional silane crosslinking agent can be expected to provide the best corrosion performance, with or without a phosphate pretreatment.

Example 4

In another example, steel test panels were evaluated for corrosion similar to that described in Example 1 except the test panels were cold rolled steel without a zinc metallic coating. In this example, the same concentrations were used in the alkaline solution of the invention but different organofunctional silanes were substituted for APS for some of the test panels. For all of the test panels of the invention, the alkaline rinsing time was reduced to five seconds instead of ten seconds. These test panels were evaluated using a standard Japanese cyclic corrosion test, i.e., CCT-4. In this test, the corrosion is less aggressive than that of the GM scab test and were exposed for a standard exposure time of three months. Results are summarized in Table 2.

TABLE 4

| Pretreatmen | Creepback (mm) |
|---|---|
| Phos only | 0.93 |
| Phos + Chromate | 0.75 |
| Invention: | |
| Phos + Silicate + GPS silane + TMSE xlinker | 1.32 |
| Phos + Silicate + MPS silane + TMSE xlinker | 1.07 |
| Phos + Silicate + SAAPS silane + TMSE xlinker | 0.71 |
| Phos + Silicate + APS silane + TMSE xlinker | 0.52 |

The results demonstrate that using the alkaline solution of the invention containing APS or SAAPS silane and a non-functional silane crosslinking agent can be expected to provide improved corrosion performance for phosphated cold rolled steel.

Example 5

In another example, steel test panels again were evaluated for corrosion similar to that described in Example 1 except the test panels were cold rolled steel, the test panels were phosphated with iron phosphate instead of zinc phosphate and the pretreated panels were painted with a conventional solvent based appliance polyester paint. After painting, the test panels were scribed through the paint and composite layer and into the steel base metal. The scribed panels then were exposed for one week to the GM scab corrosion test. After completion of the test, the panels were washed in water, dried and loose paint was removed using tape. The percentages of paint lifted from the surface area taped are summarized in Table 5.

TABLE 5

| Pretreatment | Paint Lifted (%) |
|---|---|
| Phos only | 60–70 |

TABLE 5-continued

| Pretreatment | Paint Lifted (%) |
|---|---|
| Phos + Chromate | 30–40 |
| Invention (Phos + Silicate + APS + TMSE xlinker) | 0 |

The results using a tape test demonstrated that using the alkaline solution of the invention containing APS silane and a non-functional silane crosslinking agent can be expected to improve paint adherence for phosphated cold rolled steel compared to cold rolled steel pretreated with conventional phosphate or phosphate plus chromate.

Painted steel sheet pretreated with a composite silicate layer containing siloxane has excellent long term corrosion protection and paint adherence. The inorganic silicate forms the necessary foundation for a corrosion protective layer impervious to moisture. Organofunctional silane establishes a tight covalent bond between silicate and the steel substrate and between silicate and the paint. The efficiency of the organofunctional silane is enhanced when cured by a non-functional silane so that the silicate and/or aluminate is more stabilized. That is, a crosslinked silane forms a dense network having improved adhesion to a metal substrate. The silicate provides a large number of silanol groups which are the reaction sites for the silane and the crosslinker. Thus, the network is more dense and impervious to water.

It will be understood various modifications can be made to the invention without departing from the spirit and scope of it. Therefore, the limits of the invention should be determined from the appended claims.

What is claimed is:

1. A method of pretreating metal to improve corrosion resistance, comprising the steps of: providing an alkaline solution containing at least one of a dissolved inorganic silicate and a dissolved inorganic aluminate, an organofunctional silane and a crosslinking agent including two or more trialkoxysilyl groups, the alkaline solution containing at least 0.005M of at least one of the silicate or the silicate or the aluminate, rinsing a metal sheet with the alkaline solution, and drying the sheet to form a relatively insoluble composite layer containing siloxane.

2. The method of claim 1 including the additional step of painting the composite layer.

3. The method of claim 1 wherein the alkaline solution includes at least 0.1 vol.-% of the crosslinking agent.

4. The method of claim 1 wherein the alkaline solution includes at least 0.1 vol.-% of the organofunctional silane.

5. The method of claim 4 wherein the alkaline solution includes 0.2–5.0 vol.-% of the organofunctional silane.

6. The method of claim 1 wherein the ratio of the organofunctional silane to the crosslinker in the alkaline solution is in the range of 2:1 to 10:1.

7. The method of claim 1 wherein the metal sheet is a cold rolled steel coated with a layer of zinc phosphate or iron phosphate prior to being rinsed with the alkaline solution.

8. The method of claim 1 wherein the alkaline solution has a pH≧12 and the organofunctional silane is APS.

9. The method of claim 3 wherein the alkaline solution includes at least 0.005M of a metal salt.

10. The method of claim 1 wherein the crosslinking agent is TMSE.

11. The method of claim 1 wherein the metal sheet is aluminum or an aluminum alloy and the alkaline solution contains at least 0.005M of the aluminate.

12. The method of claim 1 wherein the metal sheet is steel coated with an aluminum or an aluminum alloy metallic coating and the alkaline solution contains at least 0.005M of the aluminate.

13. A method of pretreating steel to improve corrosion resistance and paint adhesion, comprising the steps of:

providing an alkaline solution containing at least at least 0.005M of one of a dissolved inorganic silicate and a dissolved inorganic aluminate, 0.1–5.0 vol.-% of an organofunctional silane, at least 0.1 vol.-% of a crosslinking agent including two or more trialkoxysilyl groups, rinsing a steel sheet with the alkaline solution, drying the sheet to form a relatively insoluble composite layer containing siloxane, and painting the composite layer whereby the siloxane forms an adherent covalent bond between the paint and the steel substrate.

* * * * *